US009676599B1

(12) United States Patent
Baker

(10) Patent No.: US 9,676,599 B1
(45) Date of Patent: Jun. 13, 2017

(54) POWER LIFT ASSEMBLY

(71) Applicant: James T. Baker, West Monroe, LA (US)

(72) Inventor: James T. Baker, West Monroe, LA (US)

( * ) Notice: Subject to any disclaimer, the term of this patent is extended or adjusted under 35 U.S.C. 154(b) by 202 days.

(21) Appl. No.: 14/557,519

(22) Filed: Dec. 2, 2014

Related U.S. Application Data

(60) Provisional application No. 61/911,785, filed on Dec. 4, 2013.

(51) Int. Cl.
*B66F 3/00* (2006.01)
*B66F 3/25* (2006.01)
*B66F 5/04* (2006.01)

(52) U.S. Cl.
CPC . *B66F 3/25* (2013.01); *B66F 5/04* (2013.01)

(58) Field of Classification Search
CPC ..... B66F 3/25; B66F 5/04
See application file for complete search history.

(56) References Cited

U.S. PATENT DOCUMENTS 5,915,672 A * 6/1999 Dickey ..... B66F 3/24 248/352
6,986,503 B2 * 1/2006 Arzouman ..... B66F 1/08 254/2 B
7,168,685 B2 * 1/2007 Miner ..... B66F 5/00 254/8 B
7,434,783 B2 10/2008 Arzouman
7,464,914 B2 * 12/2008 Arzouman ..... B66F 1/06 254/8 B
7,878,482 B2 2/2011 Hernandez, Jr.
8,181,936 B2 5/2012 Walton
8,201,807 B2 6/2012 Hernandez, Jr.
2008/0099747 A1 * 5/2008 Arzouman ..... B66F 5/04 254/8 B
2015/0307333 A1 * 10/2015 Emsky ..... B66F 13/00 254/2 B

* cited by examiner

*Primary Examiner* — Larry E Waggle, Jr.
*Assistant Examiner* — Henry Hong
(74) *Attorney, Agent, or Firm* — R. Keith Harrison

(57) ABSTRACT

A power lift assembly includes a lift stand. An actuating unit is detachably coupled to the lift stand and includes an actuating unit frame, a hydraulic unit carried by the actuating unit frame, a hydraulic piston extendable and retractable with respect to the hydraulic unit and an actuating unit arm positional between first and second positions on the actuating unit frame. The actuating unit arm operably engages the hydraulic unit to extend and retract the hydraulic piston at the first and second positions, respectively, of the actuating unit arm. A lift arm is pivotally carried by the actuating unit frame and releasably engages the lift stand. The hydraulic piston engages the lift arm.

16 Claims, 13 Drawing Sheets

POWER LIFT ASSEMBLY

CROSS-REFERENCE TO RELATED APPLICATIONS

This application claims the benefit of U.S. provisional application No. 61/911,785, filed Dec. 4, 2013 and entitled POWER LIFT ASSEMBLY, which application is incorporated by reference herein in its entirety.

FIELD

Illustrative embodiments of the disclosure generally relate to jack stands for lifting and safely supporting vehicles or other heavy objects. More particularly, illustrative embodiments of the disclosure relate to a power lift assembly having a lift stand which engages an object to be lifted and an actuating unit which can be selectively detachably coupled to the lift stand to facilitate operation of one or more lift stands or other forms of lifting and/or support structures in raising and lowering of the object.

BACKGROUND

The background description provided herein is solely for the purpose of generally presenting the context of the illustrative embodiments of the disclosure. Aspects of the background description are neither expressly nor impliedly admitted as prior art against the claimed subject matter.

Conventional jacks may be used to lift an entire vehicle or a portion of a vehicle to facilitate repair or replacement of parts and/or maintenance of the vehicle. One or more jack stands may be used to safety maintain the vehicle in the raised position. A conventional jack may have a one-piece design which includes both a lifting mechanism that engages, lifts and lowers the vehicle and an actuating mechanism that operates the lifting mechanism. Many vehicles may have a limited number of points under the chassis to lift the vehicle. Generally, these points may be too small to fit both a jack and a jack stand which support the vehicle in an elevated position. This drawback may render placement of the vehicle on jack stands difficult and risk damaging the vehicle.

Accordingly, a power lift assembly having a lift stand which engages an object to be lifted and an actuating unit which can be selectively detachably coupled to the lift stand to facilitate operation of one or more lift stands in raising and lowering of the object may be desirable for some applications.

SUMMARY

Illustrative embodiments of the disclosure are generally directed to a power lift assembly. An illustrative embodiment of the power lift assembly includes a lift stand. An actuating unit is detachably coupled to the lift stand and includes an actuating unit frame, a hydraulic unit carried by the actuating unit frame, a hydraulic piston extendable and retractable with respect to the hydraulic unit and an actuating unit arm positional between first and second positions on the actuating unit frame. The actuating unit arm operably engages the hydraulic unit to extend and retract the hydraulic piston at the first and second positions, respectively, of the actuating unit arm. A lift arm is pivotally carried by the actuating unit frame and releasably engages the lift stand. The hydraulic piston engages the lift arm.

BRIEF DESCRIPTION OF THE DRAWINGS

Illustrative embodiments of the disclosure will now be described, by way of example, with reference to the accompanying drawings, in which.

DETAILED DESCRIPTION

Figure 1:
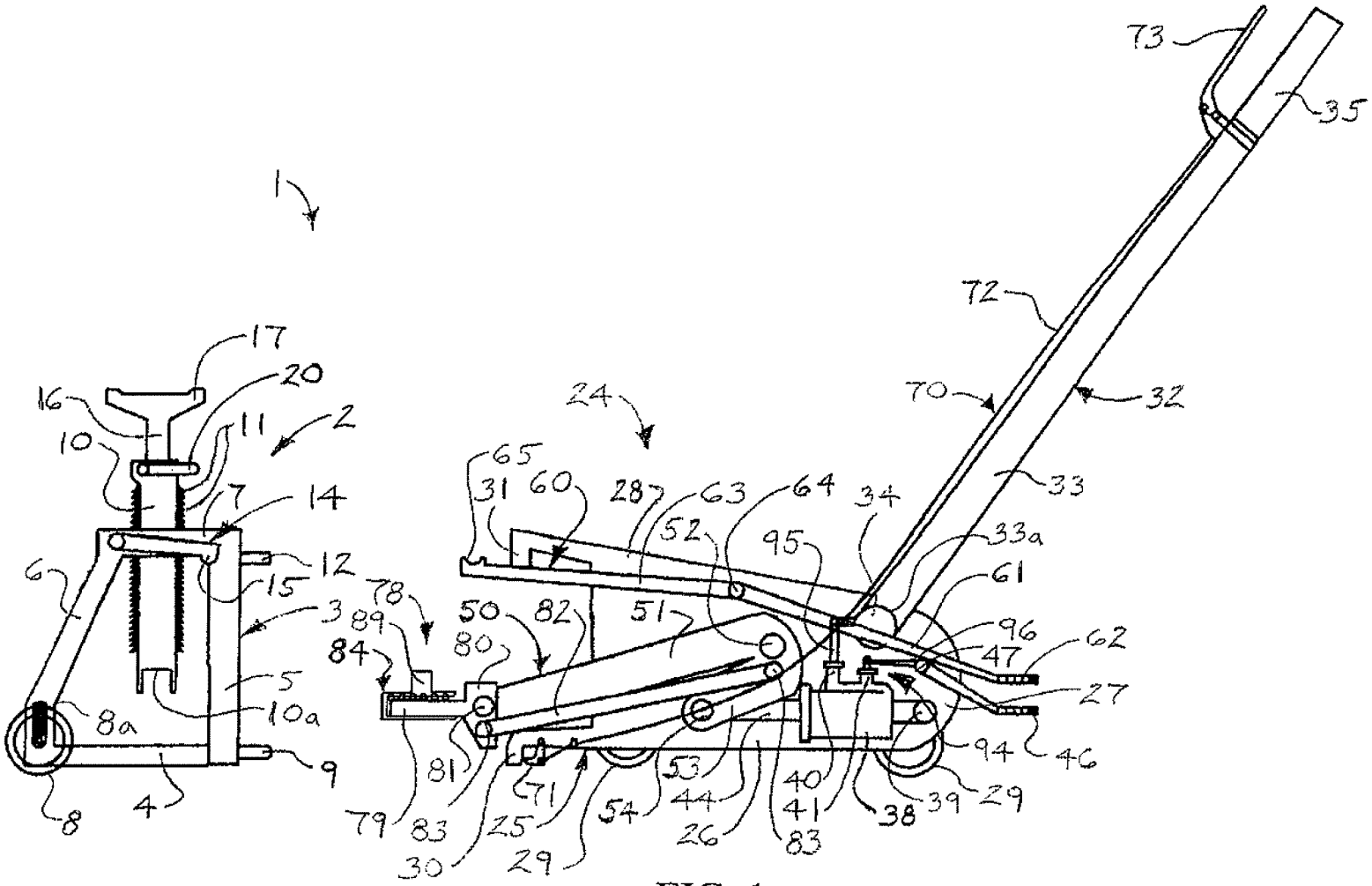
FIG. 1 is a side view of an illustrative embodiment of the power lift assembly, with an actuating unit detached from a lift stand of the assembly.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable users skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description.

Referring initially to FIGS. 1-7 of the drawings, an illustrative embodiment of the power lift assembly is generally indicated by reference numeral 1. The power lift assembly 1 includes a lift stand 2 and an actuating unit 24 which can be selectively and detachably coupled to the lift stand 2 to deploy the lift stand 2 between raised and lowered positions. In exemplary application, which will be hereinafter described, the lift stand 2 is adapted to engage and lift a vehicle or other heavy object (not illustrated) from a floor or other surface (not illustrated) responsive to operation of the actuating unit 24. In some applications, the actuating unit 24 can be operated to deploy the lift stand 2 in the raised position and can then be selectively uncoupled from the lift stand 2 as the lift stand 2 remains in the raised position to maintain the vehicle or other object elevated above the floor or surface. The actuating unit 24 can again be coupled to the lift stand 2 and operated to lower the lift stand 2. In applications in which two or more of the lift stands 2 are needed or desired to lift the vehicle or portion of the vehicle or other object, the actuating unit 24 can be used to individually and sequentially operate multiple lift stands 2 which lift and then maintain the vehicle or other object in an elevated position after the actuating unit 24 is uncoupled from each lift stand 2. After use, the actuating unit 24 can be operated to individually and sequentially lower the lift stands 2 and rest the vehicle or other heavy object on the floor or surface. The power lift assembly 1 can be fabricated of steel, carbon fiber composite and/or other suitable material using casting, molding, machining and/or other techniques known by those skilled in the art.

The lift stand 2 may include a lift stand frame 3. In some embodiments, the lift stand frame 3 may include a frame base 4. A pair of spaced-apart rear frame members 5 may extend upwardly from the frame base 4. A pair of spaced-apart front frame members 6 may extend upwardly from the frame base 4 in spaced-apart relationship to the respective rear frame members 5. A top frame member 7 may be supported by the rear frame members 5 and the front frame members 6. In other embodiments, the lift stand frame 3 may have alternative designs which are consistent with the functional requirements of the lift stand 2.

In some embodiments, at least one pair of lift stand wheels 8 may be provided on the frame base 4 of the lift stand frame 3 to render the lift stand 2 portable on the floor or other surface. A wheel lock lever 8*a* may facilitate selective locking of each lift stand wheel 8 to immobilize the lift stand 2 on the floor or surface.

A lift stand shaft 10 may be supported by the top frame member 7 of the lift stand frame 3. Multiple shaft teeth 11 may be provided on the lift stand shaft 10. A shaft release lever 14 is pivotally mounted on the lift stand frame 3. The shaft release lever 14 may normally be disposed in a lowered shaft retaining position in which the shaft release lever 14 engages the shaft teeth 1I on the lift stand shaft 10 according to the knowledge of those skilled in the art to maintain the lift stand shaft 10 at a selected height on the lift stand frame 3. In the shaft retaining position, the shaft release lever 14 allows upward movement and prevents downward movement of the lift stand shaft 10 on the lift stand frame 3. The shaft release lever 14 may be selectively pivoted from the shaft retaining position to a raised shaft release position in which the shaft release lever 14 disengages the shaft teeth 11 such that the lift stand shaft 10 can be freely moved upwardly or downwardly relative to the lift stand frame 3 for purposes which will be hereinafter further described. In some embodiments, the shaft release lever 14 may have a lever tab 15.

In some embodiments, a lift stand lift arm 16 may be selectively telescopically extendable from the lift stand shaft 10. A lift flange 17 may terminate the upper end of the lift stand lift arm 16. An arm release lever 20 may be provided on the lift stand shaft 10. The arm release lever 20 may be selectively positional between an arm lock position and an arm release position. In the arm lock position, the arm release lever 20 engages the lift stand lift arm 16 in a manner which is known by those skilled in the art to secure the lift stand lift arm 16 at a selected height relative to the lift stand shaft 10. In the arm release position, the arm release lever 20 disengages the lift stand lift arm 16 in a manner which is known by those skilled in the art to facilitate selective raising and lowering of the lift stand lift arm 16 relative to the lift stand shaft 10 and telescopic adjustment of the height of the lift flange 17.

The actuating unit 24 of the power lift assembly 1 may include an actuating unit frame 25. The actuating unit frame 25 may be generally elongated with a lower frame portion 26, a rear frame portion 27 and an upper frame portion 28. In some embodiments, multiple actuating unit wheels 29 may be provided on the actuating unit frame 25 to render the actuating unit 24 portable on the floor or other surface.

The actuating unit frame 25 of the actuating unit 24 may be adapted for detachable coupling to the lift stand frame 3 of the lift stand 2 according to any suitable technique which is known by those skilled in the art. In some embodiments, a pair of spaced-apart lower coupling brackets 9 (one of which is illustrated in FIGS. 1-4) and a pair of spaced-apart upper coupling brackets 12 may extend from the lift stand frame 3. A pair of lower engagement hooks 30 (one of which is illustrated in FIGS. 1-4) and a pair of upper engagement hooks 31 (one of which is illustrated in FIGS. 1-4) may extend from the lower frame portion 26 and the upper frame portion 28, respectively, of the actuating unit frame 25. As illustrated in FIG. 2, the lower engagement hooks 30 and the upper engagement hooks 31 may engage the respective companion lower coupling brackets 9 and upper coupling brackets 12 to detachably couple the actuating unit 24 to the lift stand 2 as will be hereinafter described.

Figure 3:
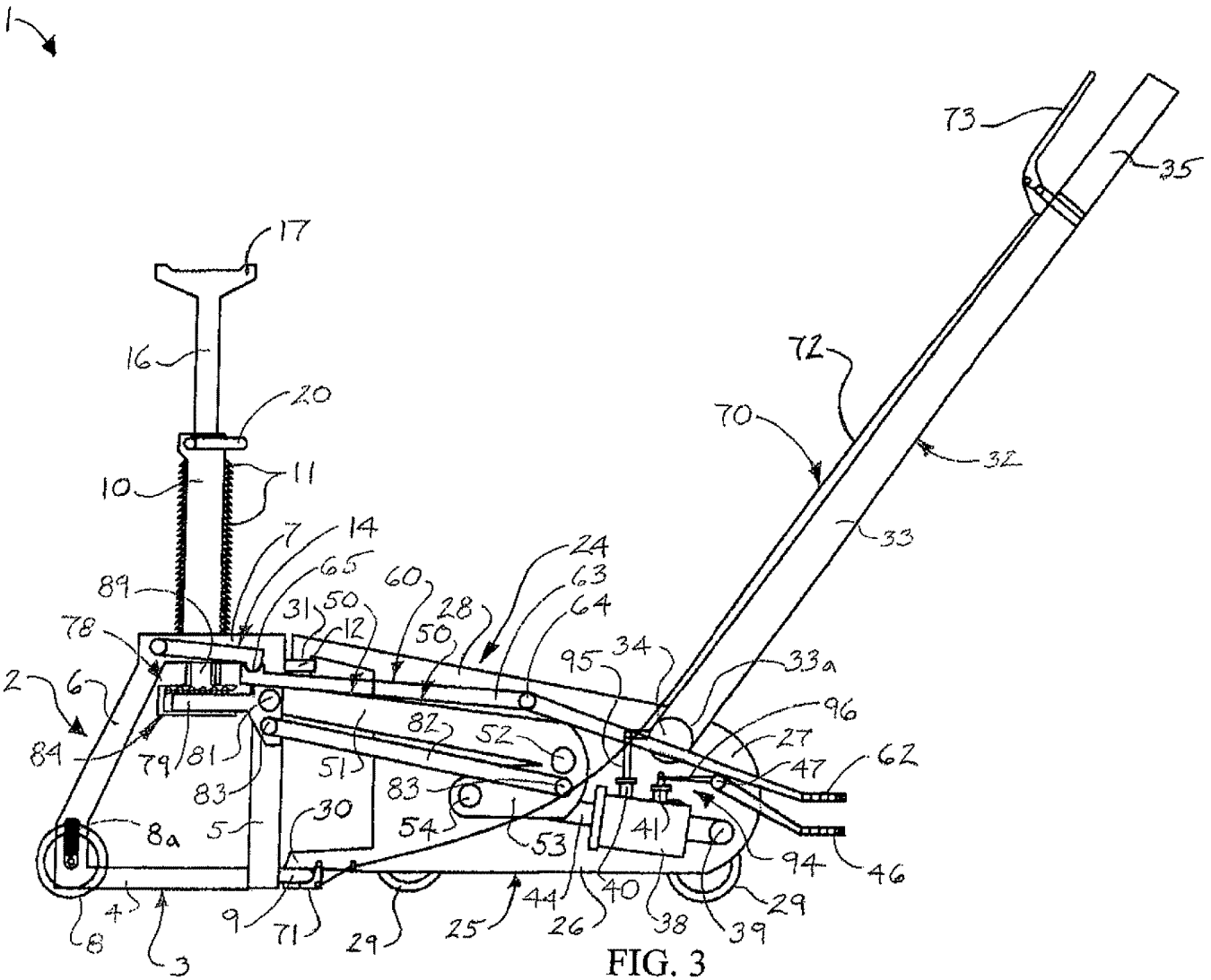
FIG. 3 is a side view of an illustrative power lift assembly, with the actuating unit coupled to the lift stand and the lift stand deployed in a raised position.

An actuating unit arm 32 includes an elongated arm shaft 33 having a lower shaft end 33*a* which is pivotally attached to the rear frame portion 27 of the actuating unit frame 25 at an arm pivot 34. A handle grip 35 may be provided on the arm shaft 33. When the actuating unit 24 is coupled to the lift stand 2 in exemplary operation of the power lift assembly 1, which will be hereinafter described, "pumping", or repeated up-and-down pivoting of the actuating unit arm 32, facilitates an increase in hydraulic pressure which raises the lift stand shaft 10 on the lift stand frame 3, as illustrated in FIG. 3. In some embodiments, a release pedal 46 may be pivotally attached to the rear frame portion 27 of the actuating unit frame 25 at a pedal pivot 47. Depression of the release pedal 46 may release hydraulic pressure to facilitate lowering of the lift stand shaft 10 on the lift stand frame 3 of the lift stand 2, as will be hereinafter further described.

A hydraulic unit 38 may be supported by the actuating unit frame 25 of the actuating unit 24. The hydraulic unit 38 may be pivotally attached to the actuating unit frame 25 via a hydraulic unit pivot 39. The hydraulic unit 38 may have an actuating arm hydraulic port 40 and a release pedal hydraulic port 41. A hydraulic piston 44 is extendable and retractable with respect to the hydraulic unit 38. As particularly illustrated in FIG. 2A, a hydraulic fluid pump mechanism 94 may include an actuating arm linkage 95 which mechanically connects the arm shaft 33 of the actuating arm 32 to the actuating arm hydraulic port 40. Accordingly, "pumping" or repeated pivoting of the actuating unit arm 32 at the arm pivot 34 causes the actuating arm linkage 95 to increase fluid pressure at the actuating arm hydraulic port 40, facilitating flow of hydraulic fluid under pressure against the hydraulic piston 44 and extension of the hydraulic piston 44 from the hydraulic unit 38.

In some embodiments, the hydraulic fluid pump mechanism 94 may further include a release pedal linkage 96 which mechanically connects the release pedal 46 to the release pedal hydraulic port 41. Accordingly, depression of the release pedal 46 causes the release pedal linkage 96 to release fluid pressure at the release pedal hydraulic port 41, facilitating retraction of the hydraulic piston 44 into the hydraulic unit 38.

It will be recognized and understood by those skilled in the art that the hydraulic fluid pump mechanism 94 which was heretofore described represents one exemplary mechanism which is suitable for the purpose of facilitating extension of the hydraulic piston 44 from the hydraulic unit 38 upon pumping movement or action of the actuating unit arm 32 and subsequent retraction of the hydraulic piston 44 into the hydraulic unit 38 upon depression of the release pedal 46. Hydraulic fluid pump mechanisms which are suitable for the purpose are well known by those skilled in the art and such mechanisms which are of alternative design and are consistent with the functional requirements of the actuating unit 24 may be used in various alternative embodiments.

A lift arm 50 is provided on the actuating unit frame 25 of the actuating unit 24. The hydraulic piston 44 operably engages the lift arm 50 in such a manner that the lift arm 50 is disposed in a lowered position (FIG. 1) when the hydraulic piston 44 is retracted in the hydraulic unit 38 and the lift arm 50 is disposed in a raised position (FIG. 4) when the hydraulic piston 44 is extended from the hydraulic unit 38. The lift arm 50 may include a generally elongated lift arm shaft 51 which is pivotally attached to the actuating unit frame 25 at a lift arm pivot 52. A lift arm flange 53 may extend from the lift arm shaft 51. The lift arm flange 53 may be pivotally attached to the hydraulic piston 44 at a piston pivot 54. Accordingly, as the hydraulic piston 44 extends from the hydraulic unit 38, the lift arm flange 53 pivots upwardly at the piston pivot 54 and the lift arm shaft 51 likewise pivots upwardly at the lift arm pivot 52. Conversely, as the hydraulic piston 44 retracts into the hydraulic unit 38, the lift arm flange 53 pivots downwardly at the piston pivot 54 and the lift arm shaft 51 likewise pivots downwardly at the lift arm pivot 52. In exemplary operation of the power lift assembly 1, which will be hereinafter further described, the lift arm 50 engages and facilitates selective raising and lowering of the lift stand shaft 10 on the lift stand frame 3 of the lift stand 2.

In some embodiments, an angle compensator 78 may be provided on the lift arm 50. The angle compensator 78 may be adapted to compensate for the distance discrepancies between the end of the lift arm 50 and the lift stand shaft 10 of the lift stand 2 at different heights of the lift arm 50. The angle compensator 78 may include an angle compensator arm 79 which extends from the lift arm shaft 51 of the lift arm 50. An angle compensator bracket 80 may be pivotally attached to the lift arm shaft 51 at an angle compensator pivot 81. The angle compensator arm 79 may extend from the angle compensator bracket 80. An elongated platform stabilizer 82 may be pivotally attached to the lift arm 50 and to the angle compensator bracket 80 at a pair of respective stabilizer pivots 83 for stabilization purposes.

Figure 7:
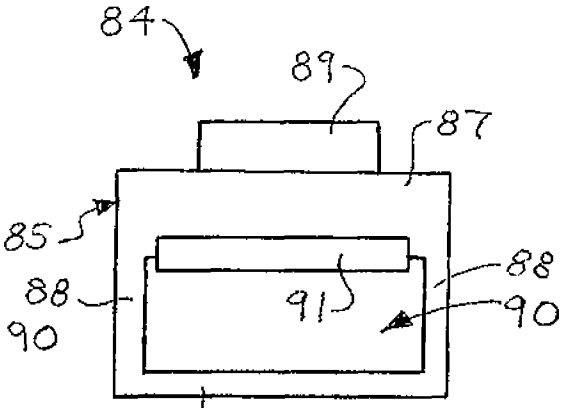
FIG. 7 is a front view of the angle compensator assembly illustrated in FIG. 6.
Figure 6:
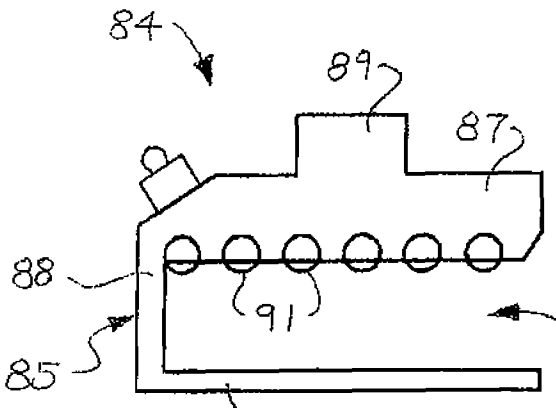
FIG. 6 is a side view of an exemplary angle compensator assembly of an angle compensator which is suitable for implementation of an illustrative power lift assembly.

An angle compensator assembly 84 is provided on the angle compensator arm 79. As illustrated in FIGS. 6 and 7, the angle compensator assembly 84 may include a compensator assembly platform 85. The compensator assembly platform 85 may include a bottom platform portion 86, a top platform portion 87 which is spaced-apart from the bottom platform portion 86 and a connecting platform portion 88 which connects the top platform portion 87 to the bottom platform portion 86. A platform slot 90 is formed by and between the bottom platform portion 86 and the top platform portion 87. A lift shaft insertion flange 89 may extend from the top platform portion 87 for purposes which will be hereinafter described.

At least one platform roller 91 is provided on the top platform portion 87 and extends into the platform slot 90. In some embodiments, multiple platform rollers 91 may be provided on the top platform portion 87 in the platform slot 90. Accordingly, the platform slot 90 of the compensator assembly platform 85 is sized and configured to accommodate the angle compensator arm 79. The lift shaft insertion flange 89 is sized and configured to engage or insert into a flange slot 10*a* (FIGS. 1 and 4) in the lower end of the lift stand shaft 10 on the lift stand 2. Therefore, as the lift arm 50 is deployed from the lowered position (FIG. 2) to the raised position (FIG. 3), the angle compensator assembly 84 travels away from the angle compensator bracket 80 as the platform rollers 91 traverse the angle compensator arm 79 to compensate for the progressively increasing distance between the end of the lift arm 50 and the lift stand shaft 10. Conversely, as the lift arm 50 is deployed from the raised position (FIG. 3) to the lowered position (FIG. 2), the angle compensator assembly 84 travels toward the angle compensator bracket 80 as the platform rollers 91 traverse the angle compensator arm 79 to compensate for the progressively decreasing distance between the end of the lift arm 50 and the lift stand shaft 10.

A stand release lever arm 60 may be provided on the actuating unit frame 25 of the actuating unit 24. The stand release lever arm 60 may include a proximal lever arm segment 61 and a distal lever arm segment 63 which extends from the proximal lever arm segment 61. The proximal lever arm segment 61 and the distal lever arm segment 63 may be pivotally attached to each other and to the actuating unit frame 25 of the actuating unit 24 at an arm pivot 64. A concave lever tab engaging surface 65 may be provided at the distal or extending end of the distal lever arm segment 63. The lever tab engaging surface 65 may normally engage the lever tab 15 on the shaft release lever 14 of the left stand 2. Accordingly, the shaft release lever 14 is normally disposed in the lowered shaft retaining position such that the shaft release lever 14 engages the shaft teeth 11 on the lift stand shaft 10 and maintains the lift stand shaft 10 at a selected height on the lift stand frame 3. Upon depression of the lift release pedal 62, the distal lever arm segment 63 pivots upwardly at the arm pivot 64, raising the lever tab engaging surface 65 such that the shaft release lever 14 pivots upwardly on the lift stand frame 3 from the shaft retaining position to the shaft release position and releases the shaft teeth 11. Consequently, the lift stand shaft 10 falls in the lift stand frame 3 until the lift release pedal 62 is released and the shaft release lever 14 again engages the shaft teeth 11 on the lift stand shaft 10.

In some embodiments, a quick release mechanism 70 may include a quick release clamp 71 which is pivotally mounted on the lower frame portion 26 of the actuating unit frame 25. The quick release clamp 71 is pivotal between a spring-loaded bracket-engaging position and a bracket release position. When the actuating unit 24 is coupled to the lift stand 2, the quick release clamp 71, in the bracket-engaging position, engages at least one of the lower coupling brackets 9 on the lift stand frame 3. A quick release cable 72 is attached to the quick release clamp 71. A quick release handle 73 on the actuating unit arm 32 is attached to the quick release cable 72. Accordingly, upon manipulation of the quick release handle 73, the quick release cable 72 pivots the quick release clamp 71 from the bracket-engaging position to the bracket release position such that the quick release clamp 71 disengages the lower coupling bracket 9. The actuating unit 24 can then be uncoupled from the lift stand 2 at the lower coupling brackets 9 and the upper coupling brackets 12.

In exemplary application, at least one power lift assembly 1 may be operated to lift or partially lift a vehicle or other heavy object (not illustrated). Accordingly, the lift stand shaft 10 is initially deployed in a lower position on the lift stand frame 3 of the lift stand 2 and secured at the selected position by manipulating the shaft release lever 14 to the lowered shaft retaining position. The lift stand 2 is placed beneath the frame of the vehicle, and the height of the lift stand lift arm 16 in the lift stand shaft 10 is adjusted until the lift flange 17 engages the frame of the vehicle. The arm release lever 20 is deployed in the arm lock position to secure the lift stand lift arm 16 at the selected height. The wheel lock lever 8*a* may be deployed in the wheel lock position to lock the lift stand wheels 8.

Figure 2:
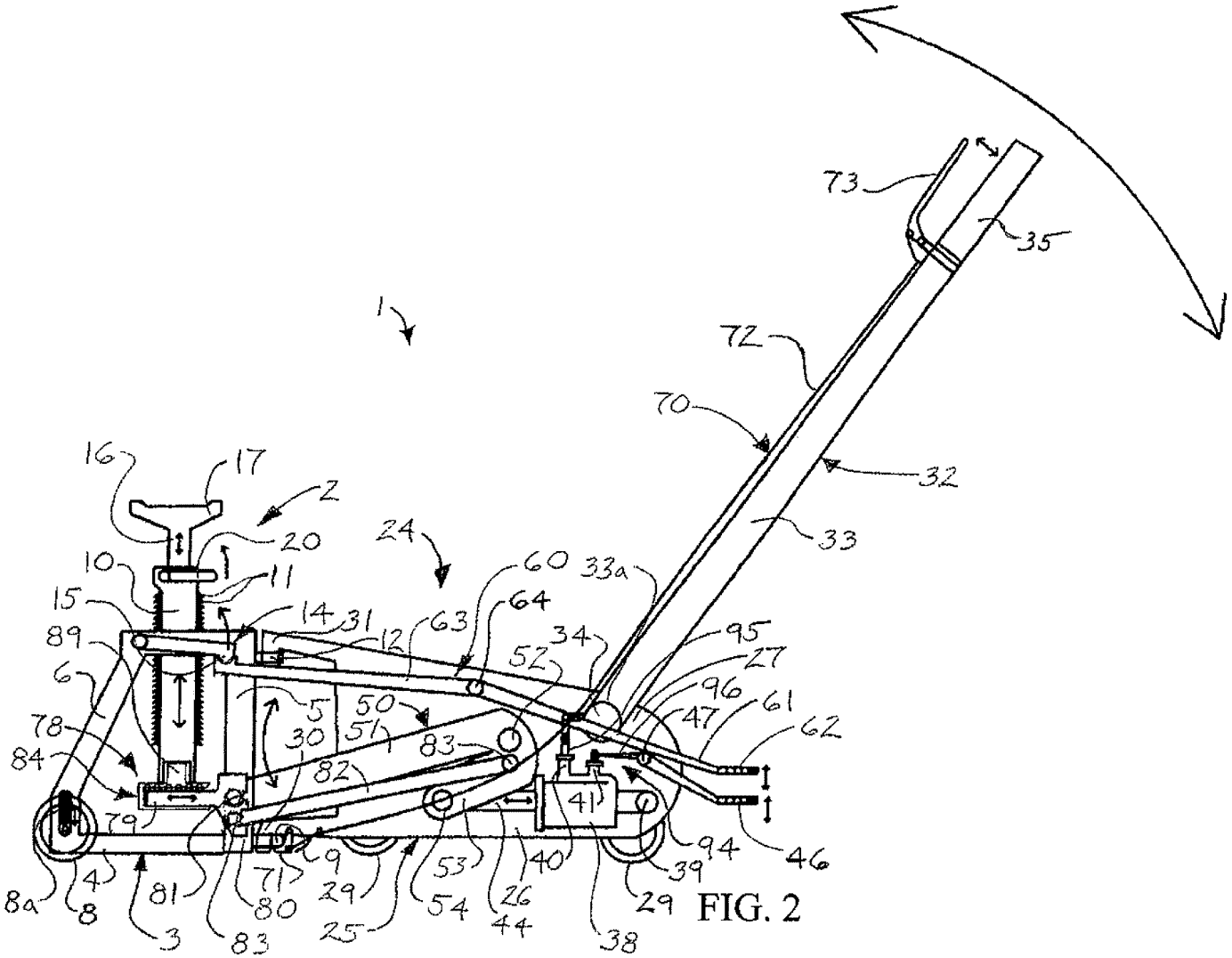
FIG. 2 is a side view of an illustrative power lift assembly, with the actuating unit coupled to the lift stand and the lift stand deployed in a lowered position.
Figure 2A:
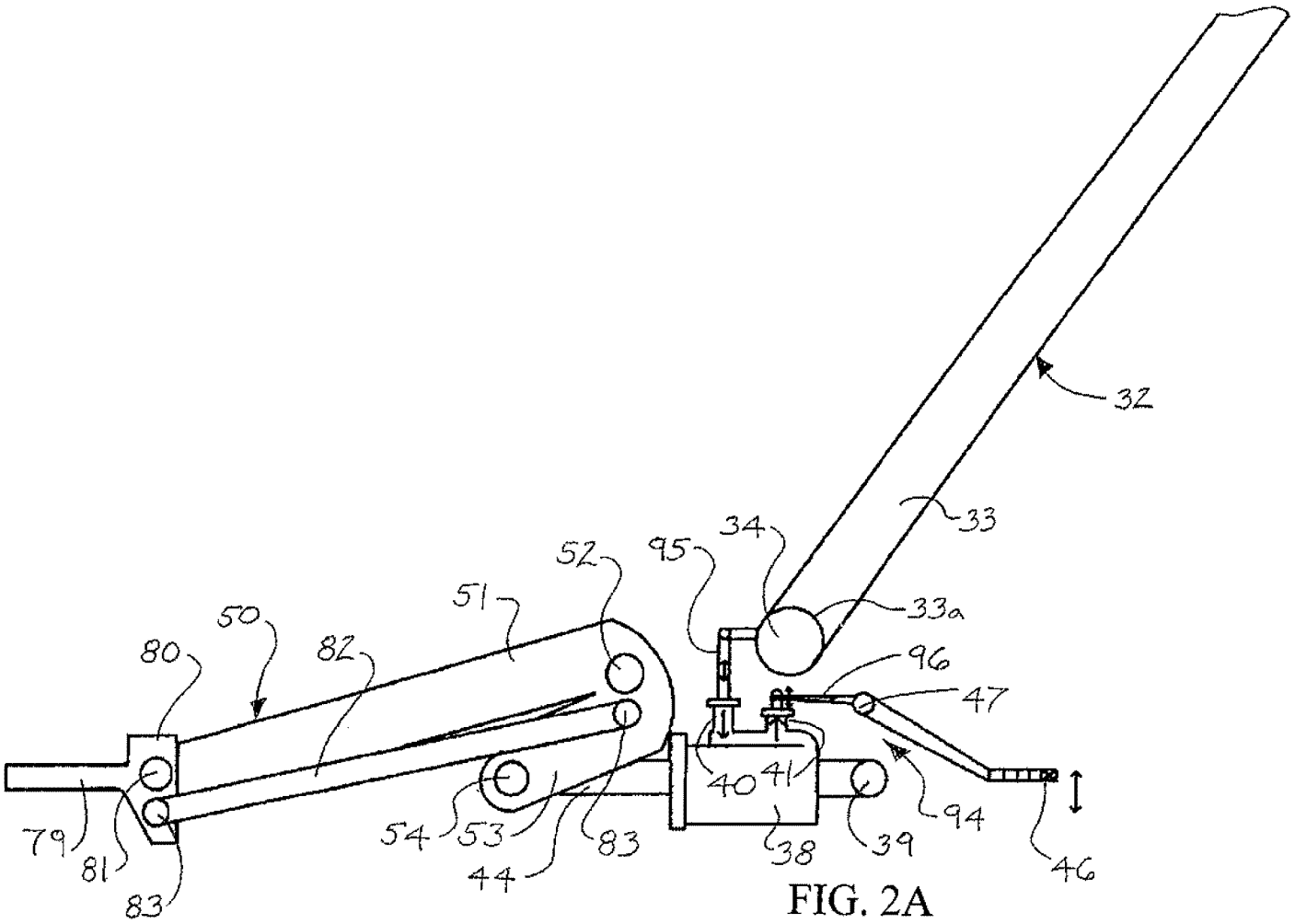
FIG. 2A is a side view of an exemplary hydraulic fluid pump mechanism which is suitable for implementation of an illustrative embodiment of the power lift assembly.

With the lift arm 50 and the angle compensator 78 deployed in the lowered position of FIG. 1, the actuating unit 24 is next coupled to the lift stand 2, as illustrated in FIG. 2. The lift shaft insertion flange 89 of the angle compensator 78 may insert in or engage the flange slot 10*a* in the lower end of the lift stand shaft 10.

The actuating unit arm 32 of the actuating unit 24 is next pumped in an up-and-down motion at the arm pivot 34. Accordingly, the hydraulic unit 38 is activated to extend the hydraulic piston 44, which raises the lift arm 50 at the lift arm pivot 52. Simultaneously, the hydraulic unit 38 may pivot upwardly with respect to the actuating unit frame 25 at the hydraulic unit pivot 39. The lift arm 50 raises the lift stand shaft 10 on the lift stand frame 3 as the shaft teeth 11 progressively engage the shaft release lever 14. The angle compensator 78 compensates for the progressively increasing distance between the pivoting lift arm 50 and the stationary lift stand shaft 10. The lift stand shaft 10 may raise the vehicle until the lift arm 50 reaches the uppermost position on the actuating unit frame 25, as illustrated in FIG. 3.

Figure 4:
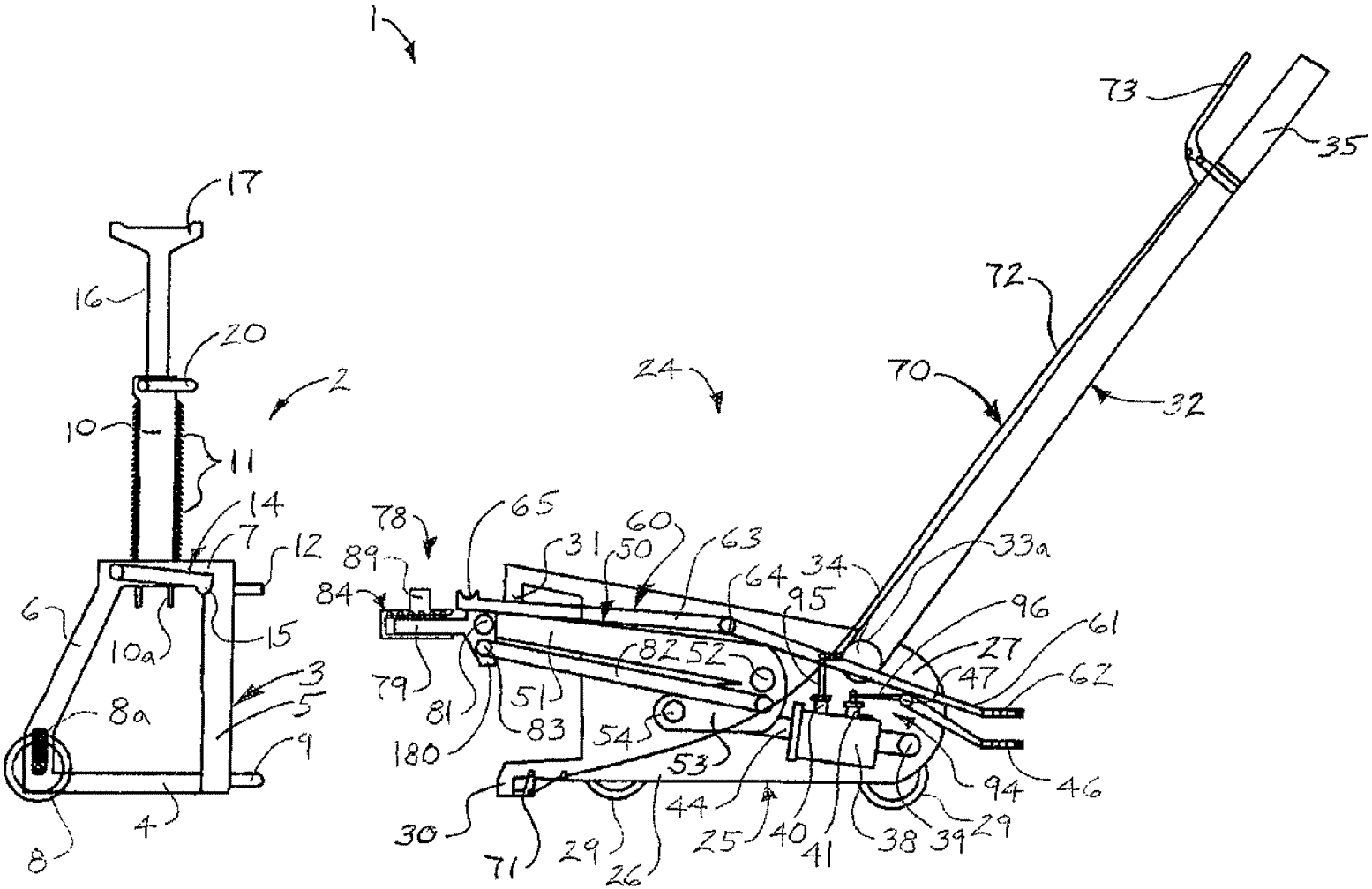
FIG. 4 is a side view of an illustrative power lift assembly, with the actuating unit uncoupled from the lift stand with the lift stand remaining in the raised position.
Figure 5:
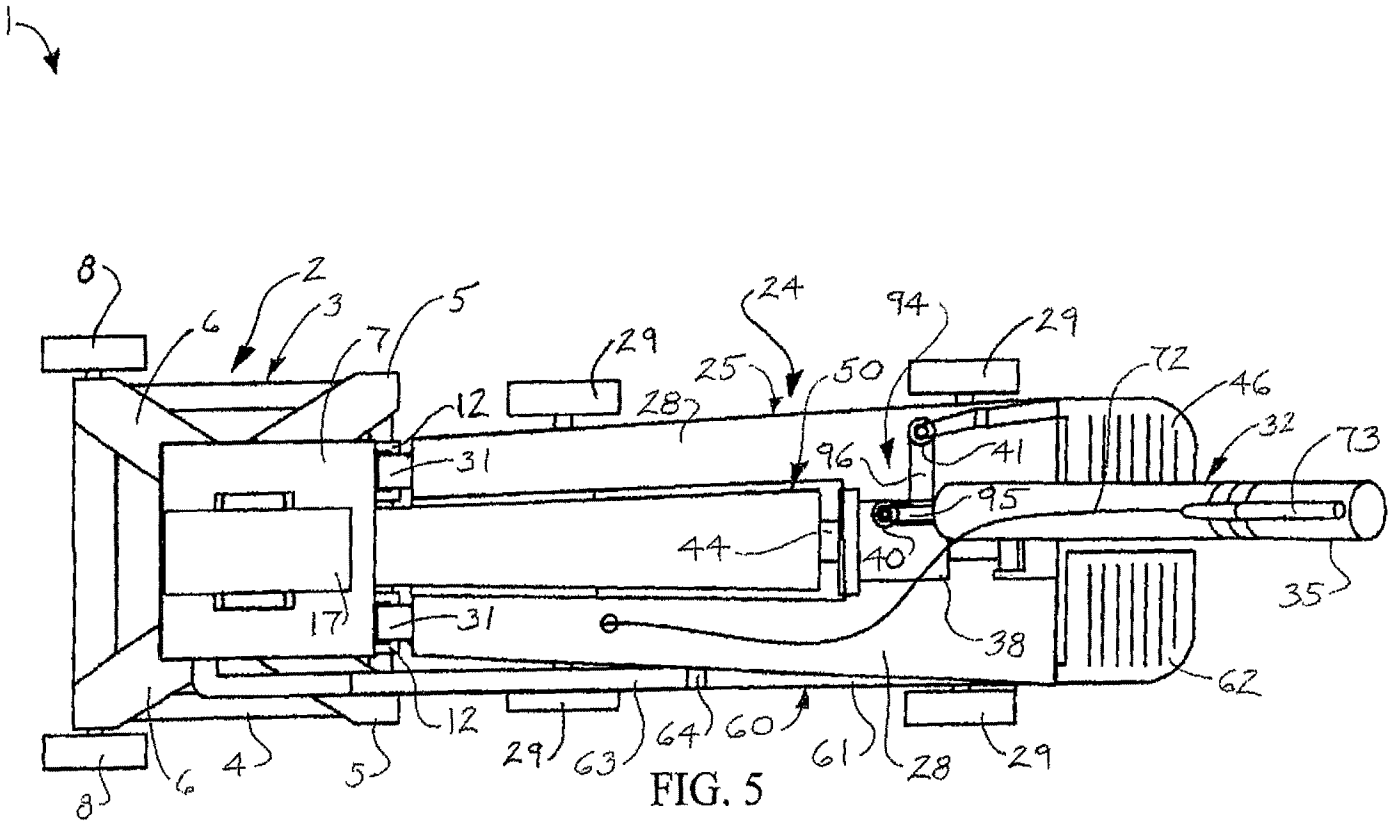
FIG. 5 is a top view of an illustrative power lift assembly, with the actuating unit coupled to the lift stand.

As illustrated in FIG. 4, the actuating unit 24 may next be uncoupled from the lift stand 2. As the angle compensator 78 disengages the lower end of the lift stand shaft 10, the shaft release lever 14 remains in the shaft retaining position and continues to engage the shaft teeth 11 to maintain the lift stand shaft 10 in the raised position. In some applications, the actuating unit 24 can be sequentially transported to additional lift stands 2 and operated to engage and actuate the lift stands 2 to raise the entire vehicle or a large portion of the vehicle. Thus, the actuating unit 24 may be transported among the lift stands 2 by rolling the actuating unit wheels 29 on the ground or other surface (not illustrated).

When the vehicle is to be subsequently lowered, the actuating unit 24 is again coupled to the lift stand 2 and the angle compensator 78 engages the lower surface of the lift stand shaft 10, as illustrated in FIG. 3. The release pedal 46 may be depressed to release the hydraulic unit 38, retract the hydraulic piston 44 and lower the lift arm 50 and the lift stand shaft 10. Accordingly, the retracting hydraulic piston 44 gradually lowers the lift arm 50 on the actuating unit frame 25, and the lift arm 50 lowers the lift stand shaft 10 on the lift stand frame 3. Simultaneously, the hydraulic unit 38 may pivot downwardly with respect to the actuating unit frame 25 at the hydraulic unit pivot 39. Thus, the lift stand shaft 10 lowers the vehicle back onto the floor or other surface. After the wheel lock levers 8*a* are released, the power lift assembly 1 may be rolled from beneath the vehicle. In applications in which multiple lift stands 2 are used to lift the vehicle, the actuating unit 24 can be sequentially transported and coupled to each lift stand 2 and operated to lower the lift stand shaft 10 of each lift stand 2, as was heretofore described.

Referring next to FIGS. 8-11 of the drawings, an alternative illustrative embodiment of the power lift assembly is generally indicated by reference numeral 101. In the power lift assembly 101, elements which are analogous to the respective elements of the power lift assembly 1 that was heretofore described with respect to FIGS. 1-7 are designated by the same numeral in the 101-199 series in FIGS. 8-11. The lift stand 102 of the power lift assembly 101 may include a lift stand frame 103 having a frame base 104 and at least one rear frame member 113 upward-standing from the frame base 104. The frame base 104 may be fitted with at least one pair of lift stand wheels 108. A pair of lower coupling brackets 109 and a pair of upper coupling brackets 112 may extend from the rear frame member 113.

A lift arm head 166 may be supported by the lift arm shaft 151 of the lift arm 150. A chassis support head 174 may be supported by the lift arm head 166. An angle compensator 178 may include a lift arm slot 167 which is sized and shaped to accommodate the angle compensator arm 179 on the angle compensator bracket 180 which is pivoted to the end of the lift arm shaft 151 via the angle compensator pivot 181. A chassis support head slot 168 may be provided in the lift arm head 166 generally adjacent to the lift arm slot 167.

Figure 8:
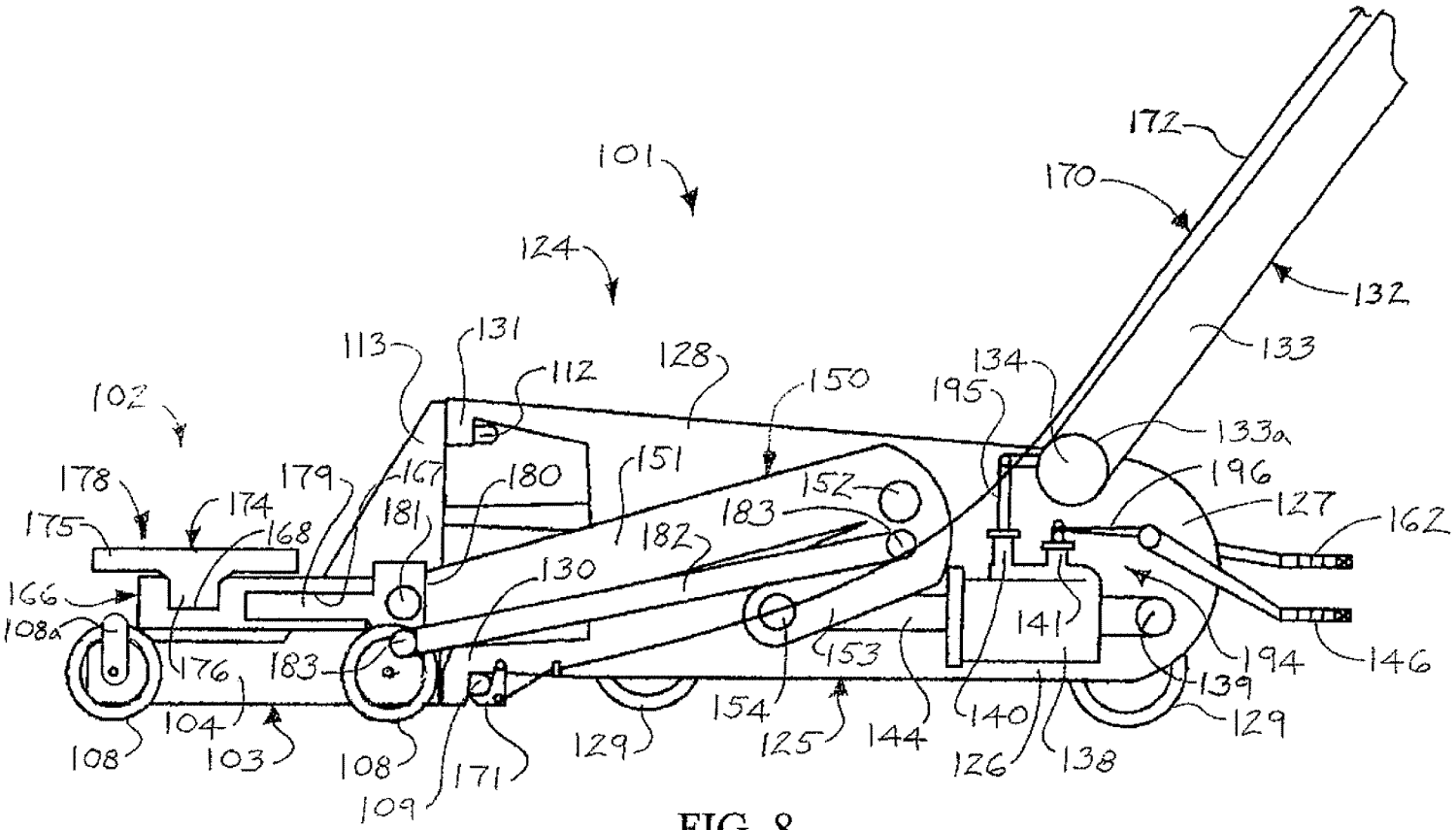
FIG. 8 is a side view of an alternative illustrative power lift assembly, with the actuating unit coupled to the lift stand and the lift stand deployed in a lowered position.
Figure 9:
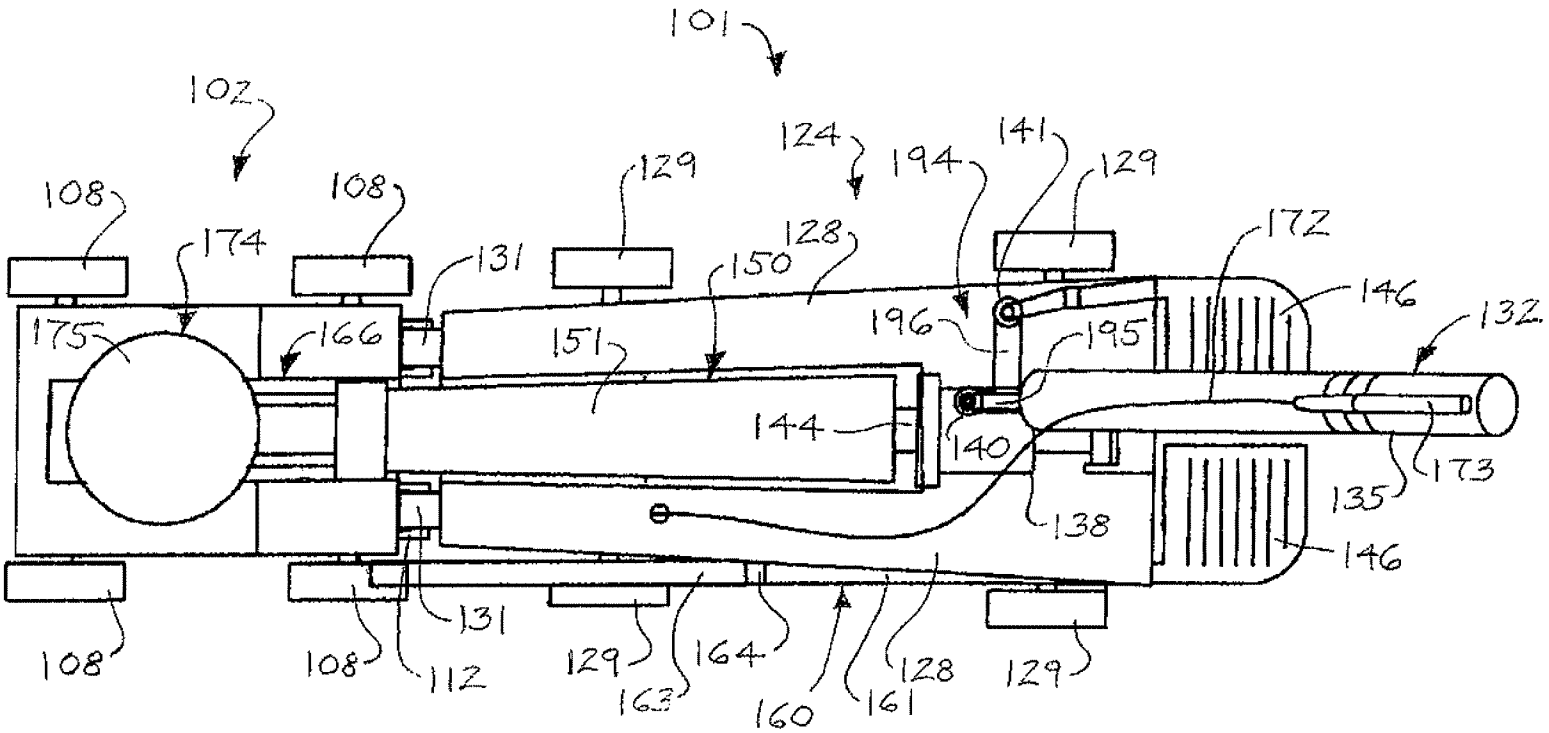
FIG. 9 is a top view of the illustrative power lift assembly illustrated in FIG. 8, with the actuating unit coupled to the lift stand.
Figure 10:
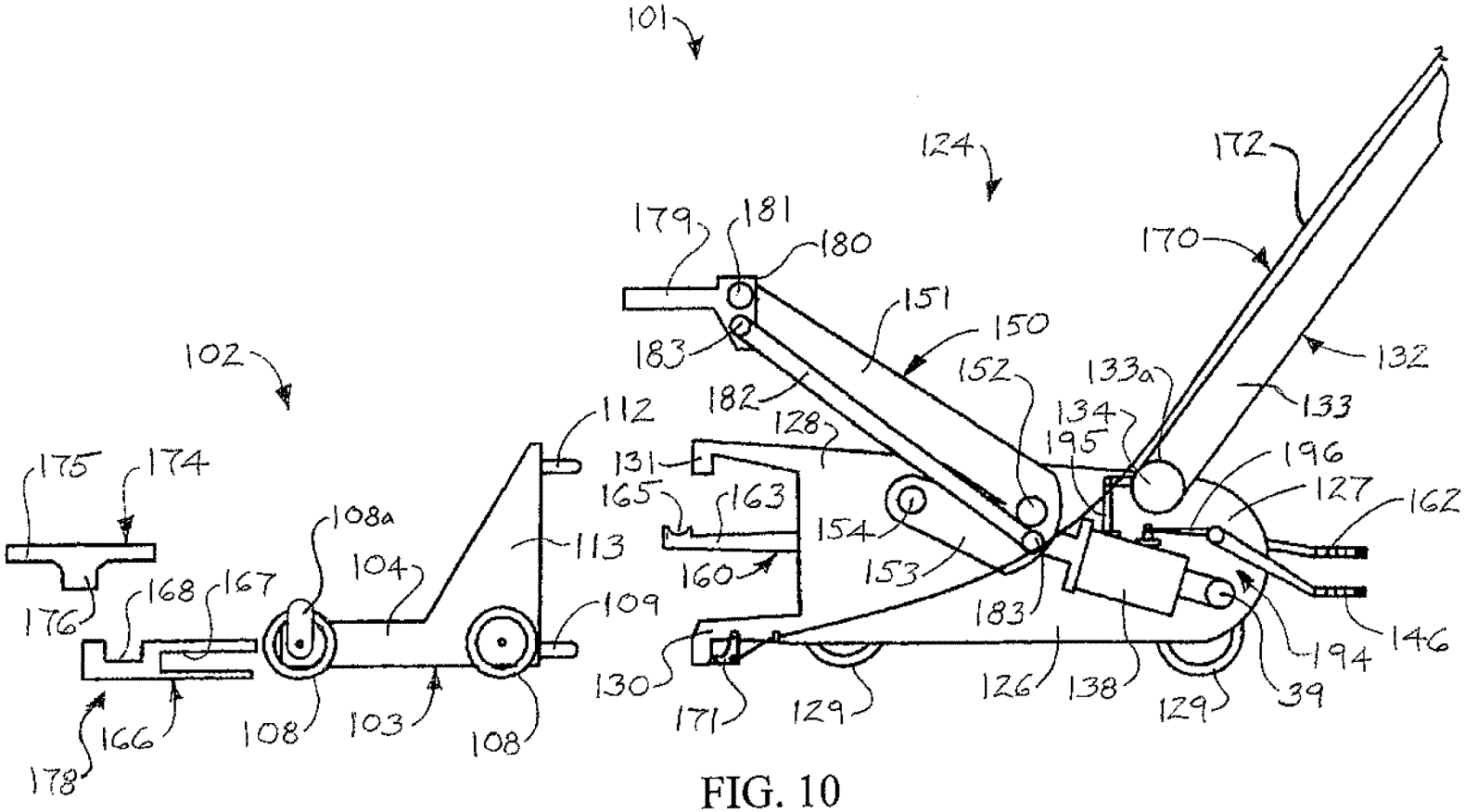
FIG. 10 is an exploded side view of the illustrative power lift assembly illustrated in FIG. 8, with an actuating unit detached from a lift stand of the assembly.
Figure 11:
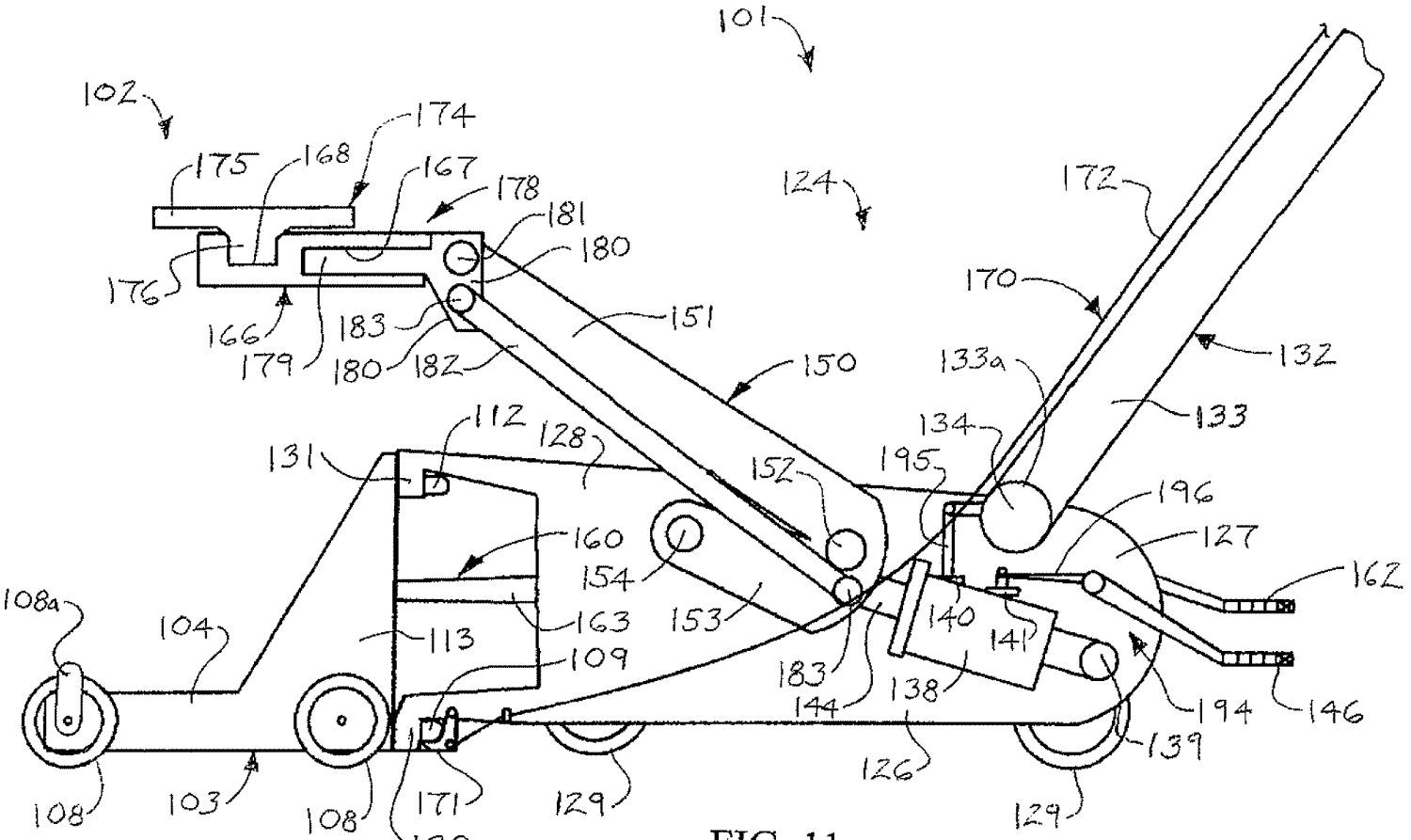
FIG. 11 is a side view of the illustrative power lift assembly illustrated in FIG. 8, with the actuating unit coupled to the lift stand and the lift stand deployed in a raised position.

The chassis support head 174 of the lift stand 102 may include a chassis support head plate 175 and a chassis support head flange 176 which extends from a lower surface of the chassis support head plate 175. The chassis support head slot 168 in the lift arm head 166 is sized and shaped to accommodate the chassis support head flange 176 on the chassis support head plate 175 of the chassis support head 174. Accordingly, when the hydraulic piston 144 is retracted in the hydraulic unit 138 of the hydraulic fluid pump mechanism 194 and the lift arm 150 is deployed in the lower position, as illustrated in FIG. 8, the lift arm head 166 may rest on the frame base 104 of the lift stand frame 103. Upon extension of the hydraulic piston 144 from the hydraulic unit 138, as illustrated in FIG. 11, the lift arm 150 raises the lift arm head 166 and the chassis support head 174 supported thereon. The angle compensator arm 179 may slide within the lift arm slot 167 of the angle compensator 178 to compensate for the distance discrepancies between the end of the lift arm 150 and the lift arm head 166 of the lift stand 102 at different heights of the lift arm 150.

Exemplary application of the power lift assembly 101 may be as was heretofore described with respect to the power lift assembly 1 in FIGS. 1-7. At least one power lift assembly 101 may be operated to lift or partially lift a vehicle or other heavy object (not illustrated). Accordingly, the lift arm head 166 is initially deployed in a lower position on the lift stand frame 103 of the lift stand 102 by retracting the hydraulic piston 144 into the hydraulic unit 138 of the hydraulic fluid pump mechanism 194. The lift stand 102 is placed beneath the frame of the vehicle. The wheel lock lever 108*a* may be deployed in the wheel lock position to lock the lift stand wheels 108. With the lift arm 150 and the angle compensator 178 deployed in the lowered position, the actuating unit 124 is next coupled to the lift stand 102, as illustrated in FIG. 8.

The actuating unit arm 132 of the actuating unit 124 is next pumped in an up-and-down motion at the arm pivot 134 and the hydraulic unit 138 activated to extend the hydraulic piston 144, which raises the lift arm 150 at the lift arm pivot 152. Simultaneously, the hydraulic unit 138 may pivot upwardly with respect to the actuating unit frame 125 at the hydraulic unit pivot 139. The lift arm 150 raises the lift arm head 166 and the chassis support head 174 from the lowered position illustrated in FIG. 8 to the raised position illustrated in FIG. 11. The angle compensator 178 compensates for the progressively increasing distance between the pivoting lift arm 150 and the stationary lift arm head 166. The lift arm head 166 may raise the vehicle until the lift arm 150 reaches the uppermost position on the actuating unit frame 125, as further illustrated in FIG. 11.

At least one jack stand (not illustrated) which may have a conventional design may be adjusted in height to match the raised height of the vehicle. In some applications, the lift stand 2 (FIG. 1) may be utilized for the purpose. The arm release lever 20 is deployed in the arm lock position to secure the lift stand lift arm 16 at the selected height. The adjusted jack stand or lift stand 2 may then be positioned beneath the vehicle, after which the lift arm 150 and the lift arm head 166 and the chassis support head 174 may be returned to the lowered position of FIG. 8 typically by actuation of the release pedal 146. Accordingly, the jack stand or stands or lift stand 2 or lift stands 2 support the vehicle at the raised height. In some applications, the power lift assembly 101 can be transported to other locations and operated to raise the entire vehicle or a large portion of the vehicle. Thus, the power lift assembly 101 may be transported by rolling the lift stand wheels 108 and the actuating unit wheels 129 on the ground or other surface (not illustrated).

When the vehicle is to be subsequently lowered, the chassis support head 174 and the lift arm head 166 in the lowered position are again positioned beneath the vehicle. The hydraulic fluid pump mechanism 194 is next operated to extend the hydraulic piston 144 from the hydraulic unit 138 and raise the lift arm 150 such that the chassis support head 174 engages and lifts the vehicle from the jack stand or stands. The jack stand or stands are removed from beneath the vehicle, after which the release pedal 146 may be depressed to release the hydraulic unit 138, retract the hydraulic piston 144 and lower the lift arm 150 and the lift arm head 166 and chassis support head 174. Accordingly, the retracting hydraulic piston 144 gradually lowers the lift arm 150 on the actuating unit frame 125, and the lift arm 150 lowers the lift arm head 166 onto the lift stand frame 103. Simultaneously, the hydraulic unit 138 may pivot downwardly with respect to the actuating unit frame 125 at the hydraulic unit pivot 139. Thus, the chassis support head 174 lowers the vehicle back onto the floor or other surface. The power lift assembly 101 may then be rolled from beneath the vehicle.

Figure 12B:
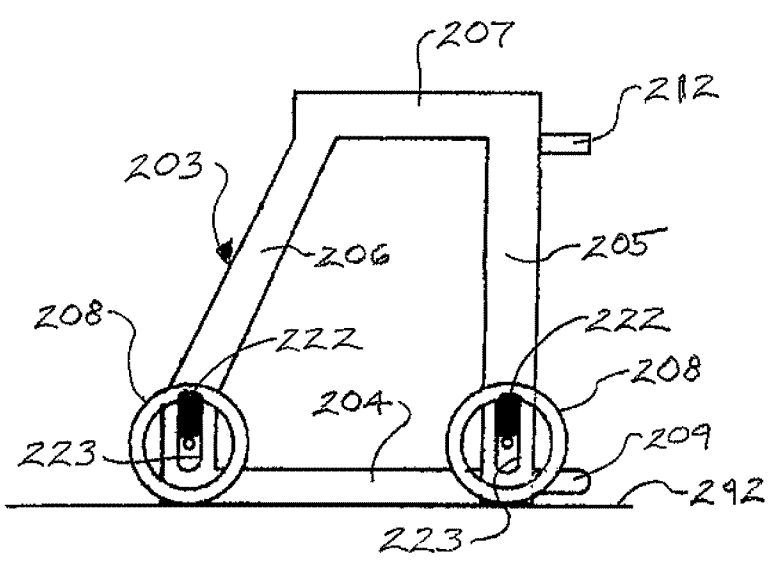
FIG. 12B is a side view of the lift stand frame illustrated in FIG. 12A, with the lift stand frame deployed in a lowered position.
Figure 12A:
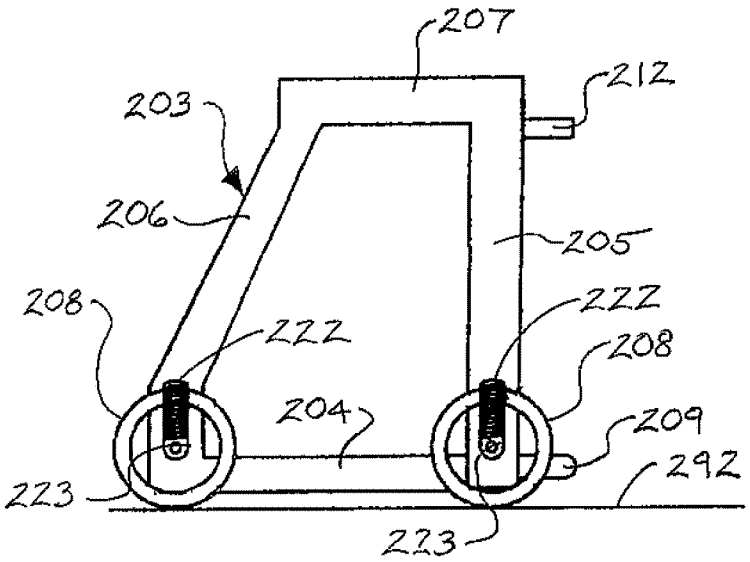
FIG. 12A is a side view of the lift stand frame of a lift stand according to another alternative illustrative embodiment of the power lift assembly, with the lift stand frame deployed in a raised position.

Referring next to FIGS. 12A and 12B of the drawings, a lift stand frame of a lift stand according to another alternative illustrative embodiment of the power lift assembly is generally indicated by reference numeral 203. In the lift stand frame 203, elements which are analogous to the respective elements of the lift stand frame 3 of the power lift assembly 1 that was heretofore described with respect to FIGS. 1-7 are designated by the same numeral in the 201-299 series in FIGS. 12A and 12B. Two pairs of lift stand wheels 208 may be provided on the lift stand frame 203. Each lift stand wheel 208 may be slidably and vertically mounted in a corresponding wheel slot 223 in the lift stand frame 203. A spring assembly 222 may normally bias each lift stand wheel 208 in a lowered position, as illustrated in FIG. 12A, such that the frame base 204 of the lift stand frame 203 is elevated above the floor 292. Upon application of weight to the lift stand frame 203, the lift stand wheels 208 slide upwardly in the respective wheel slots 223, against the bias imparted by the spring assemblies 222, until the frame base 204 of the lift stand frame 203 rests on the floor or other support surface 292. The strength of each spring assembly 222 may be sufficient to support the weight of the power lift assembly 201, plus some for fatigue. This automatically lowers the stand 202 onto the support surface when weight is applied, thus securing the stand for safe support. The strength of each spring assembly 222 may additionally be selected to compensate for fatigue of each spring assembly 222 over time. Application of the lift stand frame 203 may be as was heretofore described with respect to the lift stand frame 3 of the lift stand 2 on the power lift assembly 1 which was heretofore described with respect to FIGS. 1-7.

Figure 13:
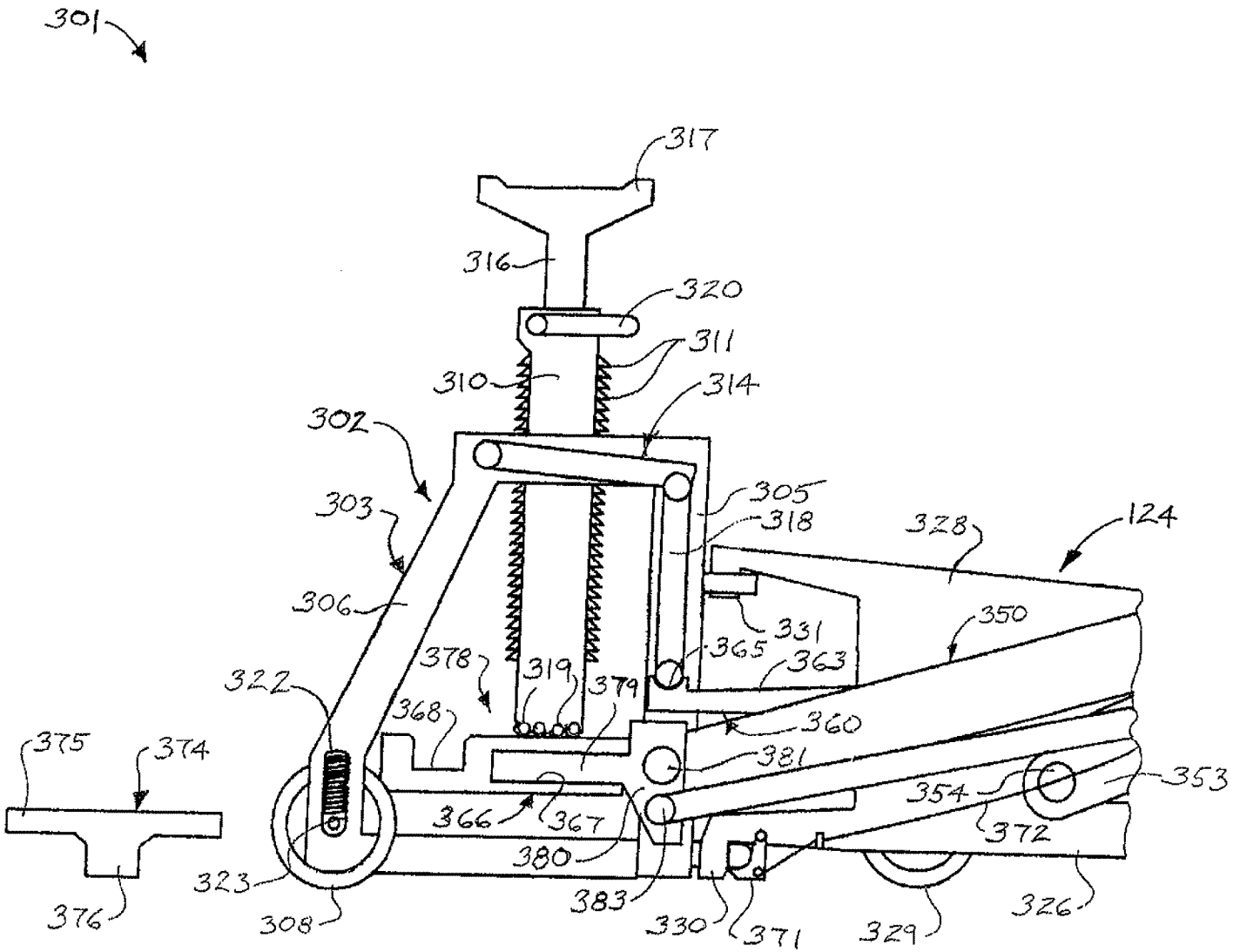
FIG. 13 is an exploded side view, partially in section, of a lift stand according to yet another alternative illustrative embodiment of the power lift assembly.

Referring next to FIG. 13 of the drawings, a lift stand 302 according to yet another alternative illustrative embodiment of the power lift assembly 301 is illustrated. In the lift stand 302, elements which are analogous to the respective elements of the lift stand 2 of the power lift assembly 1 that was heretofore described with respect to FIGS. 1-7 are designated by the same numeral in the 302-399 series in FIG. 13. The lift stand 302 may have a design which is the same as or similar to that of the lift stand 2 which was heretofore described with respect to FIGS. 1-7. The lift arm head 366 may be provided on the angle compensator arm 379 extending from the angle compensator bracket 380 on the end of the lift aim 350, as was heretofore described with respect to FIGS. 8-11.

The lower end of the lift stand shaft 310 may be supported by the lift arm head 366. The angle compensator 378 of the lift stand 302 may include multiple stand lift shaft bearings 319 between the lower end of the lift stand shaft 310 and the lift arm head 366. Operation of the power lift assembly 301 may be as was heretofore described with respect to operation of the power lift assembly 1 in FIGS. 1-7. Accordingly, the stand lift shaft bearings 319 may roll between the lift stand shaft 310 and the lift arm head 366 as the lift arm 350 is raised and lowered to compensate for the distance discrepancies between the end of the lift arm 350 and the lift stand shaft 310 of the lift stand 302 at different heights of the lift arm 350.

While various illustrative embodiments have been described above, it will be recognized and understood that various modifications can be made and the appended claims are intended to cover all such modifications which may fall within the spirit and scope of the disclosure.

What is claimed is:

1. A power lift assembly, comprising:

a lift stand including:

a lift stand frame; and a lift stand shaft carried by the lift stand frame, the lift stand shaft positional between raised and lowered positions; and an actuating unit detachably coupled to the lift stand, the actuating unit including:
an actuating unit frame;
a hydraulic unit carried by the actuating unit frame;
a hydraulic piston extendable and retractable with respect to the hydraulic unit;
an actuating unit arm positional between first and second positions on the actuating unit frame, the actuating unit arm operably engaging the hydraulic unit to extend and retract the hydraulic piston at the first and second positions, respectively, of the actuating unit arm;
a lift arm pivotally carried by the actuating unit frame and releasably engaging the lift stand shaft of the lift stand, the hydraulic piston engaging the lift arm; and
an angle compensator including:
an angle compensator bracket carried by the lift arm;
an angle compensator arm extending from the angle compensator bracket; and
an angle compensator assembly having:
a compensator assembly platform including a platform slot receiving the angle compensator arm, the compensator assembly platform operable to engage the lift stand shaft of the lift stand to raise and lower the lift stand shaft responsive to operation of the lift arm; and
a plurality of platform rollers in the platform slot, the plurality of platform rollers engaging the angle compensator arm.

2. The power lift assembly of claim 1 wherein the lift arm comprises a lift arm shaft pivotally carried by the actuating unit frame and a lift arm flange extending from the lift arm shaft, and wherein the hydraulic piston pivotally engages the lift arm flange.

3. The power lift assembly of claim 1 wherein the lift stand frame of the lift stand comprises a frame base, a pair of rear frame members upward-standing from the frame base, a pair of front frame members upward-standing from the frame base and a top frame member carried by the pair of rear frame members and the pair of front frame members, and the lift stand shaft is carried by the top frame member.

4. The power lift assembly of claim 1 further comprising a lift stand lift arm telescopically extendable from the lift stand shaft and a lift arm flange on the lift stand lift arm.

5. The power lift assembly of claim 1 further comprising a plurality of shaft teeth on the lift stand shaft and a shaft release lever pivotally carried by the lift stand frame of the lift stand, the shaft release lever normally disposed in a lowered shaft retaining position wherein the shaft release lever engages the shaft teeth on the lift stand shaft to maintain the lift stand shaft at a height on the lift stand frame.

6. The power lift assembly of claim 5 further comprising a stand release lever arm pivotally carried by the actuating unit frame of the actuating unit, a lever tab engaging surface on a first end of the stand release lever arm and positional to engage the shaft release lever on the lift stand frame of the lift stand and a lift release pedal on a second end of the stand release lever arm.

7. The power lift assembly of claim 6 wherein the stand release lever arm comprises a proximal lever arm segment, a distal lever arm segment and an arm pivot pivotally connecting the proximal lever arm segment and the distal lever arm segment to the actuating unit frame, the lift release pedal on the proximal lever arm segment and the lever tab engaging surface on the distal lever arm segment.

8. A power lift assembly, comprising:
an actuating unit including:
an actuating unit frame;
a hydraulic unit carried by the actuating unit frame;
a hydraulic piston extendable and retractable with respect to the hydraulic unit;
an actuating unit arm positional between first and second positions on the actuating unit frame, the actuating unit arm operably engaging the hydraulic unit to extend and retract the hydraulic piston at the first and second positions, respectively, of the actuating unit arm; and
a lift arm pivotally carried by the actuating unit frame and releasably engaging a lift stand shaft of a lift stand, the hydraulic piston engaging the lift arm; and
the lift stand including:
a lift stand frame, the actuating unit detachably coupled to the lift stand frame;
a lift arm head carried by the lift arm of the actuating unit;
a chassis support head carried by the lift arm head; and
an angle compensator including:
an angle compensator bracket carried by the lift arm;
an angle compensator arm extending from the angle compensator bracket; and
an angle compensator assembly having:
a compensator assembly platform including a platform slot receiving the angle compensator arm, the compensator assembly platform operable to engage the lift stand shaft of the lift stand to raise and lower the lift stand shaft responsive to operation of the lift arm; and
a plurality of platform rollers in the platform slot, the plurality of platform rollers engaging the angle compensator arm.

9. The power lift assembly of claim 8 wherein the lift arm comprises a lift arm shaft pivotally carried by the actuating unit frame and a lift arm flange extending from the lift arm shaft, and wherein the hydraulic piston pivotally engages the lift arm flange.

10. The power lift assembly of claim 8 wherein the lift stand frame comprises a wheeled frame base and a rear frame member carried by the frame base.

11. The power lift assembly of claim 10 further comprising a plurality of coupling brackets carried by the rear frame member and a plurality of engagement hooks carried by the actuating unit frame of the actuating unit, the plurality of engagement hooks detachably engaging the plurality of coupling brackets, respectively.

12. The power lift assembly of claim 8 wherein the chassis support head comprises a chassis support head plate carried by the lift arm head.

13. A power lift assembly, comprising:
a lift stand including:
a lift stand frame;
a lift stand shaft carried by the lift stand frame, the lift stand shaft positional between raised and lowered positions;
at least one pair of lift stand wheels on the lift stand frame; and
a spring assembly normally biasing each of the pair of lift stand wheels in a lowered position; and
an actuating unit detachably coupled to the lift stand, the actuating unit including:
an actuating unit frame;
a hydraulic unit carried by the actuating unit frame;
a hydraulic piston extendable and retractable with respect to the hydraulic unit;

an actuating unit arm positional between first and second positions on the actuating unit frame, the actuating unit arm operably engaging the hydraulic unit to extend and retract the hydraulic piston at the first and second positions, respectively, of the actuating unit arm;

a lift arm pivotally carried by the actuating unit frame and releasably engaging the lift stand shaft of the lift stand, the hydraulic piston engaging the lift arm; and an angle compensator including:

an angle compensator bracket carried by the lift arm;

an angle compensator arm extending from the angle compensator bracket; and an angle compensator assembly having:

a compensator assembly platform including a platform slot receiving the angle compensator arm, the compensator assembly platform operable to engage the lift stand shaft of the lift stand to raise and lower the lift stand shaft responsive to operation of the lift arm; and a plurality of platform rollers in the platform slot, the plurality of platform rollers engaging the angle compensator arm.

14. The power lift assembly of claim 13 wherein the lift arm comprises a lift arm shaft pivotally carried by the actuating unit frame and a lift arm flange extending from the lift arm shaft, and wherein the hydraulic piston pivotally engages the lift arm flange.

15. The power lift assembly of claim 13 wherein the lift stand frame of the lift stand comprises a frame base, a pair of rear frame members upward-standing from the frame base, a pair of front frame members upward-standing from the frame base and a top frame member carried by the pair of rear frame members and the pair of front frame members, and the lift stand shaft is carried by the top frame member.

16. The power lift assembly of claim 13 further comprising a plurality of shaft teeth on the lift stand shaft and a shaft release lever pivotally carried by the lift stand frame of the lift stand, the shaft release lever normally disposed in a lowered shaft retaining position wherein the shaft release lever engages the shaft teeth on the lift stand shaft to maintain the lift stand shaft at a height on the lift stand frame.

* * * * *